US009295952B2

(12) United States Patent
Kornfeld et al.

(10) Patent No.: US 9,295,952 B2
(45) Date of Patent: Mar. 29, 2016

(54) VENTURI TUBE FLUID MIXER WITH AT LEAST TWO INFLECTION POINTS IN THE DIVERGENT SECTION

(75) Inventors: Matthias Kornfeld, Mödling (AT); Peter Dolovai, Vienna (AT); Tino Lindner-Silwester, Vienna (AT)

(73) Assignee: Hoerbiger Kompressortechnik Holding GmbH, Vienna (AT)

( * ) Notice: Subject to any disclaimer, the term of this patent is extended or adjusted under 35 U.S.C. 154(b) by 898 days.

(21) Appl. No.: 13/561,639

(22) Filed: Jul. 30, 2012

(65) Prior Publication Data

US 2013/0032223 A1 Feb. 7, 2013

(30) Foreign Application Priority Data

Aug. 3, 2011 (AT) ..... A 1125/2001

(51) Int. Cl.
*B01F 5/04* (2006.01)

(52) U.S. Cl.
CPC ..... *B01F 5/0428* (2013.01); *B01F 2005/0448* (2013.01); *Y10T 137/2599* (2015.04)

(58) Field of Classification Search
CPC ..... B01F 2215/0072; B01F 13/002; B01F 5/0428; B01F 3/0446; B01F 2005/0446; B01F 5/0413–5/0448; B01F 2005/0431–2005/0448
USPC ..... 366/173.1, 174.1, 175.2, 181.8, 182.4, 366/182.2, 163.1, 163.2, 167.1, 176.1, 337, 366/181.5; 137/888–896
See application file for complete search history.

(56) References Cited

U.S. PATENT DOCUMENTS

| | | | | |
|---|---|---|---|---|
| 3,394,549 | A | 7/1968 | Sutor | |
| 4,123,800 | A | 10/1978 | Mazzei | |
| 6,280,615 | B1 * | 8/2001 | Phillips | B01F 3/0446 210/198.1 |
| 6,318,071 | B2 | 11/2001 | Häggander et al. | |
| 6,574,964 | B1 | 6/2003 | Häggander et al. | |
| 2002/0096792 | A1 * | 7/2002 | Valela | B01F 3/0446 261/4 |
| 2004/0062689 | A1 | 4/2004 | Gauthier et al. | |
| 2013/0032223 | A1 * | 2/2013 | Kornfeld | B01F 5/0428 137/115.11 |

FOREIGN PATENT DOCUMENTS

| | | | | |
|---|---|---|---|---|
| CN | 2239841 | | 11/1996 | |
| CN | 1202952 | | 12/1998 | |
| DE | 102013016454 | A1 * | 4/2014 | |
| SU | 1404101 | A1 * | 6/1988 | B01F 5/0415 |
| WO | WO 9312043 | A1 * | 6/1993 | B01F 3/04609 |
| WO | WO 2010000071 | A1 * | 1/2010 | B01F 3/0446 |

OTHER PUBLICATIONS

English Abstract of CN1202952.
English Abstract of CN2239841.

* cited by examiner

*Primary Examiner* — Charles Cooley
(74) *Attorney, Agent, or Firm* — Dykema Gossett PLLC

(57) ABSTRACT

A fluid mixer in the form of a Venturi tube includes a divergent section (A2) with a steady contour curve having at least two inflection points (W1, W2) to reduce flow separations.

2 Claims, 1 Drawing Sheet

VENTURI TUBE FLUID MIXER WITH AT LEAST TWO INFLECTION POINTS IN THE DIVERGENT SECTION

BACKGROUND OF THE INVENTION

1. Field of the Invention

The present invention relates to a fluid mixer in which a first fluid flowing with subsonic speed through a Venturi tube is mixed with a second fluid fed via admixing openings, wherein in the Venturi tube, a first convergent section is provided which extends from an inlet cross-section up to the narrowest cross-section of the Venturi tube, and a second divergent section is provided which extends from the narrowest cross-section up to the outlet cross-section.

2. The Prior Art

Fluid mixers are used to mix two fluids, such as, e.g., air and fuel gas for a gas engine, in a desired ratio and as homogenous as possible. Such fluid mixers are usually constructed as Venturi tubes and operate in the subsonic range at substantially constant ambient pressure, Here, a first fluid, e.g., air, flows through the Venturi tube, wherein the speed of the fluid never reaches sonic speed. At the narrowest point of the Venturi tube, thus at the point at which the dynamic pressure (velocity pressure) is at a maximum and the static pressure (resting pressure) is at a minimum, a second gas, such as, e.g., gas or liquid fuel, is fed via openings in the Venturi tube. However, sonic speed is not reached in the narrowest cross-section which, as is well known, results in deceleration of the flow in the subsequent divergent part and thus in an increase of the static pressure. Due to the decelerated flow, the divergent nozzle region is particularly sensitive with regard to flow separation of the fluid mixture flowing therethrough. Accordingly, a problem in existing fluid mixers is the flow separation in the divergent part of the fluid mixer and accompanying disadvantageous pressure losses.

De Laval nozzles are principally to be distinguished from such fluid mixers operating according to the Venturi principle. A de Laval nozzle is a nozzle for accelerating a compressible gas flow from a subsonic state to a supersonic state. For accelerating a gas in the subsonic region, a narrowing (convergent) contour is required. The incoming subsonic flow is accelerated in the convergent nozzle part up to narrowest critical cross-section to sonic speed and from there is further accelerated to supersonic speed. This is based on the physical fact that a supersonic flow is accelerated in a diffusor (in contrast to a subsonic flow which is decelerated in a diffusor). Thus, there is an accelerated flow in the entire de Laval nozzle and the static pressure decreases monotonically with the increasing speed. Due to the existing stability of the accelerated flow, flow separations of the gas flowing through are not important. The much more important effect in the case of supersonic flows in a de Laval nozzle is the so-called compression shock which is generated by sudden deceleration of the flow to subsonic conditions and involves significant losses. Whether such a compression shock occurs in a de Laval nozzle depends entirely on the pressure ratio between nozzle inlet and nozzle outlet and the ratio of minimum cross-section to outlet cross-section. Such de Laval nozzles are frequently used as rocket nozzles, wherein here also so-called double bell geometries are known which, on the one hand, shall prevent compaction shocks from occurring and, on the other, shall also form defined separation edges at which the flow shall separate at defined conditions so that for all altitudes, a de Laval nozzle as optimal as possible is available. Thus, a flow separation is induced here in a targeted manner.

Such de Laval nozzles are known, e.g., from EP 862 688 B1, WO 00/34641 A1, or U.S. Pat. No. 3,394,549 A.

It is therefore an object of the present invention to provide a fluid mixer which operates according to the Venturi principle and is insensitive to flow separations in the divergent part.

SUMMARY OF THE INVENTION

This object is achieved by a fluid mixer in which the divergent section has in the flow direction a steady contour curve with at least two inflection points. The significant novelty in the area of the Venturi nozzles is therefore the shape of the flow contour in the divergent mixer part. The shape is optimized such that flow separation can be avoided as much as possible, or can be significantly delayed, and occurring separation regions and thus flow losses can be kept to a minimum.

If the admixing opening is moved from the narrowest cross-section into the convergent nozzle region, the fuel gas mass flow of the first fluid including the admixed mass flow of the second fluid can advantageously flow in the still accelerating flow, thus in a region which is inherently less sensitive to flow separations, and can get in close contact to the wall again. In contrast, when admixing in the narrowest cross-section with the flow decelerating at the same time in the divergent mixer part, an immediate disadvantageous flow separation would take place caused by the disturbance of the flow in close proximity to the wall due to the admixed fluid mass flow.

BRIEF DESCRIPTION OF THE DRAWINGS

The present invention is described hereinafter with reference to the FIGS. 1 and 2 which show schematic illustrations of advantageous configurations of the invention. In the figures.

DETAILED DESCRIPTION OF THE PREFERRED EMBODIMENT

Figure 1:
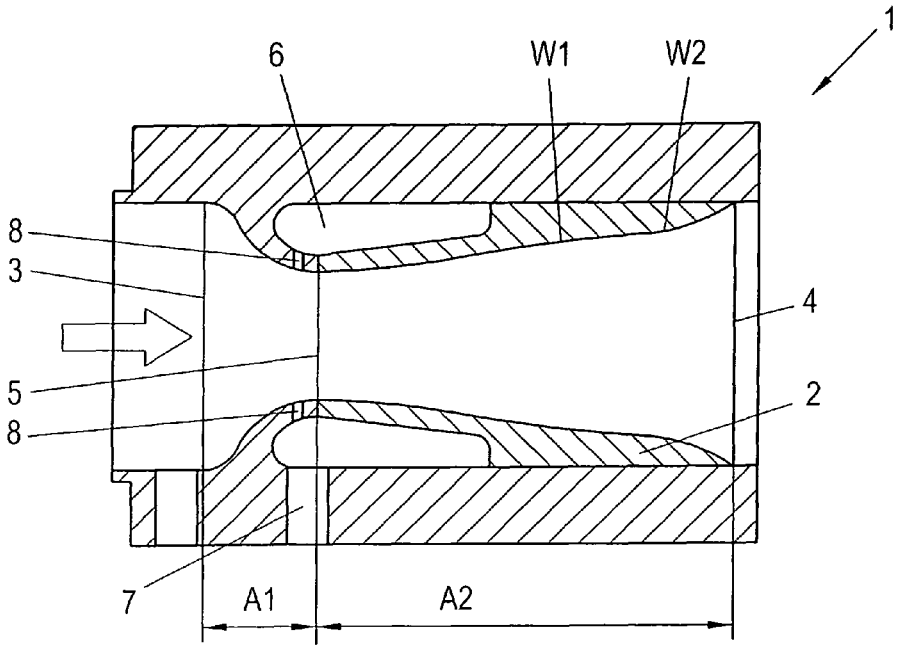
FIG. 1 shows a cross-section through a fluid mixer according to the invention.

The inventive fluid mixer 1 according to FIG. 1 comprises a Venturi tube 2 which is implemented here at the same time as a housing of the fluid mixer 1. The flow direction through the fluid mixer is indicated by the arrow in FIG. 1. A first fluid, e.g. air, is fed through an inlet cross-section 3, and the fluid mixture is discharged from the fluid mixer 1 via an outlet cross-section 4.

Figure 2:
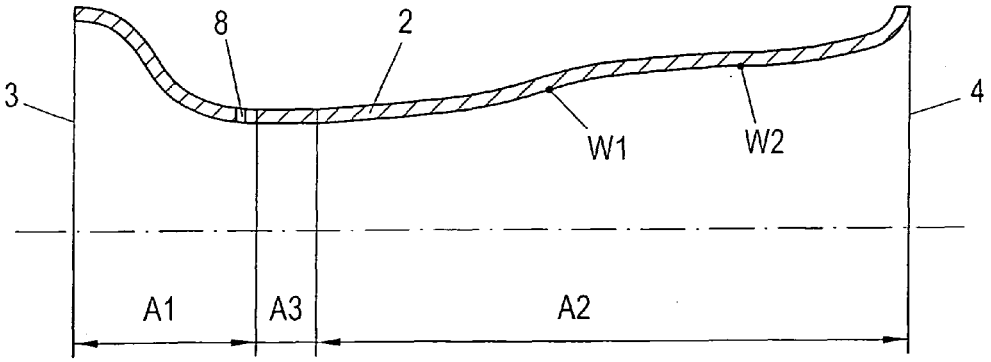
FIG. 2 shows an enlarged illustration of the curve contour of the Venturi tube in the longitudinal direction.

The Venturi tube 2 comprises a convergent section A1 which extends from the inlet cross-section 3 up to the narrowest cross-section 5 of the Venturi tube 2. The narrowest cross-section 5 can also be configured as a third, cylindrical section A3, as indicated in FIG. 2. "Convergent" means here that the cross-section decreases in the flow direction, The Venturi tube 2 further comprises a second divergent section A2 which extends from the narrowest cross-section 5 of the Venturi tube 2 up to the outlet cross-section 4. "Divergent" means here that the cross-section increases in the flow direction.

Furthermore, a recess 6 is provided in the Venturi tube 2, which recess is connected to a feed opening 7 for a second fluid, The recess 6 is preferably arranged annularly about the inner contour of the Venturi tube 2, In the region of the narrowest cross-section (or, respectively, the third section A3), a number of admixing openings 8 are provided which are distributed over the circumference and are connected to the recess 6 and thus to the feed opening 7. The admixing openings 8 are advantageously arranged in the region of the first convergent section A1, thus in the flow direction upstream of the narrowest cross-section 5 or, respectively, the third section A3. However, the admixing openings can also be arranged at the narrowest cross-section 5.

The inner flow contour of the Venturi tube 2 in the flow direction is illustrated in detail in FIG. 2. The flow contour of the divergent section A2 has two inflection points W1 and W2, wherein the contour curve is steady. Individual divergent subsections of the divergent section A2 may also be approximated by a straight line wherein, however, the divergent section A2 as a whole has to remain steady. A curve is steady in the meaning of the invention if it has in each point only one tangent. An inflection point is to be understood here as a point of the curve in which the curve changes its curvature behavior, thus changes from a left curve to a right curve. Thus, the result is a double-divergent second section A2.

The invention claimed is:

1. A fluid mixer in which a first fluid flowing with subsonic speed through a Venturi tube is mixed with a second fluid fed via admixing openings, comprising a Venturi tube which defines a convergent section having an inner wall providing a decreasing internal cross-section from an inlet cross-section to a narrowest cross-section, and a divergent section having an inner wall providing an increasing internal cross-section from the narrowest cross-section an outlet cross-section, wherein the inner wall of the divergent section has a steady contour curve with at least two inflection points.

2. The fluid mixer according to claim 1, wherein the admixing openings are located in the inner wall of the convergent section.

* * * * *